United States Patent [19]

Sergerie

[11] 4,003,549

[45] Jan. 18, 1977

[54] CARPET STRETCHER TOOL

[76] Inventor: Fernand Sergerie, 629 Dieppe St., Timmins, Ontario, Canada

[22] Filed: Apr. 9, 1975

[21] Appl. No.: 566,250

[30] Foreign Application Priority Data

Apr. 19, 1974 Canada ..... 197862

[52] U.S. Cl. ..... 254/62

[51] Int. Cl.[2] ..... A47G 27/04

[58] Field of Search ..... 254/59–63, 254/114

[56] References Cited

UNITED STATES PATENTS

| | | | |
|---|---|---|---|
| 300,396 | 6/1884 | Poindexter | 254/59 |
| 317,296 | 5/1885 | Carter | 254/62 |
| 452,508 | 5/1891 | Rice | 254/60 |
| 1,033,552 | 7/1912 | Dehlinger | 254/57 |
| 1,072,599 | 9/1913 | Gibbons | 254/58 |

*Primary Examiner*—James L. Jones, Jr.
*Assistant Examiner*—Robert C. Watson

[57] ABSTRACT

A tool adapted to stretch a carpet and distinctively including a needle bar or pointed end forming abutment by insertion at any desired point of a floor independently of any structural abutment, such as a wall. In a preferred embodiment, the carpet stretcher tool includes a pad having needles projecting from the bottom face for gripping on a carpet, a tubular arm slidably displaceable endwise toward and away from the needled pad, the needle bar being adjustably slidable lengthwise into the tubular arm and having a pointed free end, an actuting lever pivotally interconnecting the needled pad to the tubular arm to produce sliding between the needled pad and the pointed free end, and a second needle bar attached to the tubular arm closer to the needled pad than the first needle bar to allow stretching a carpet on the steps of a stair. In a second embodiment, the stretching action is produced by rocking of a convex needled pad relative to an arm having a pointed free end.

5 Claims, 6 Drawing Figures

CARPET STRETCHER TOOL

This invention relates to a carpet stretcher tool and, more particularly, to a carpet stretcher tool of the type particularly adapted to be restrained at a fixed point on a floor and to stretch a carpet away from that point for proper laying of the carpet.

Carpet stretcher tools of the above type have been proposed so far and are adapted to abut solely against a wall or other similar abutment and use telescopic tube sections to form an abutment arm of suitable length to reach the available abutment. Such an interior carpet stretcher tool is therefore of limited and time-consuming use and is not adapted to stretch a carpet on the steps of a stair.

Other carpet stretcher tools of the above type have also been proposed wherein a pin or other pointed protuberance is driven into the floor to restrain the tool at a fixed point. However, in these other carpet stretcher tools, the pointed element was disadvantageously positioned on the opposite side of the carpet engaging head relative to a handle arm, or the like. Thus, these tools cannot operate right against a wall and the pointed element forms an obstacle to displacement and proper fixing of the carpet.

It is a general object of the present invention to provide a carpet stretcher tool which operates right against a wall or the like and which is independent of a fixed abutment, such as a wall, to provide the stretching action.

It is another object of the present invention to provide a carpet stretcher tool of the above type which is easily and readily adjustable in length to take abutment at any appropriate distance from the portion of the carpet which is to be pulled to produce the stretching.

It is a further object of the present invention to provide a carpet stretcher tool of the above type which is of simple construction and operation and which allows stretching of a carpet on the steps of a stair.

The above and other objects and advantages of the present invention will be better understood in the light of the following description of preferred embodiments thereof which are illustrated, by way of example, in the accompanying drawings, in which.

Figure 1:
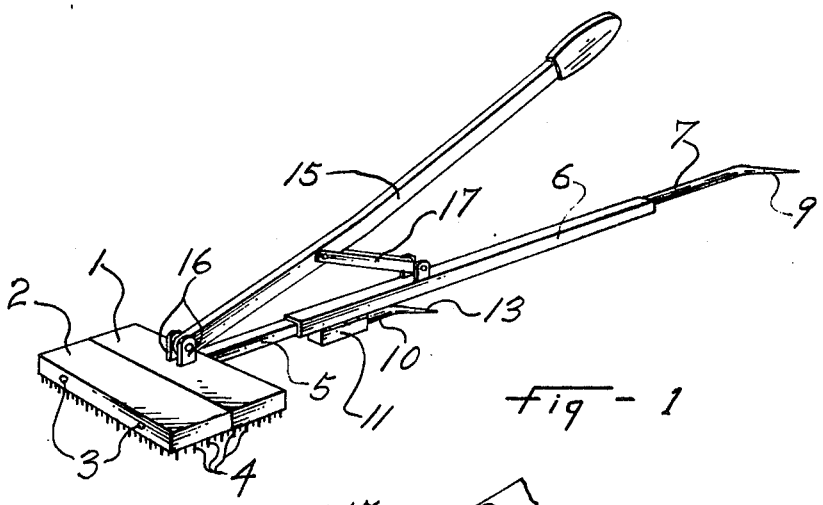
FIG. 1 is a perspective view a carpet stretcher tool according to a first embodiment of the invention.
Figure 2:
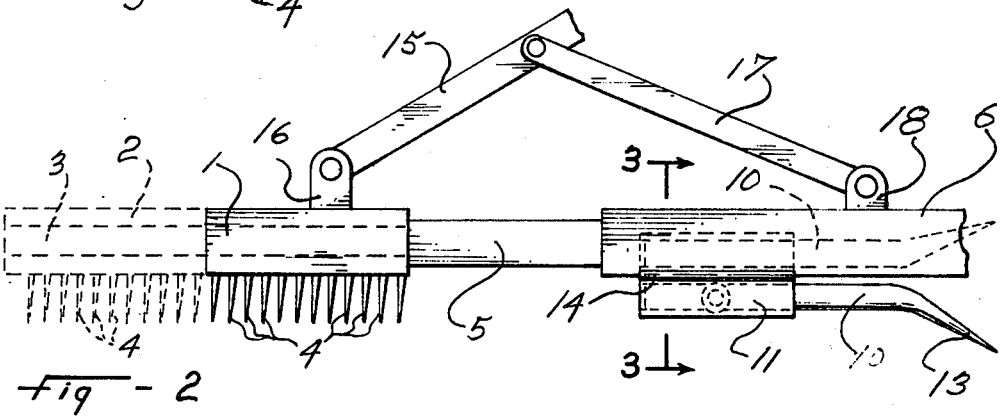
FIG. 2 is an enlarged side view of a portion of the tool shown in FIG. 1.
Figure 4:
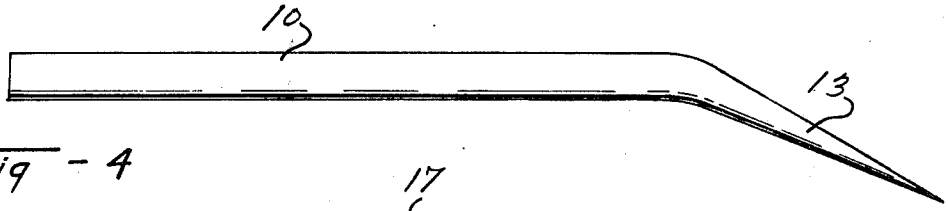
FIG. 4 is a side view of a needle bar forming part of the tool illustrated in the previous views.
Figure 3:
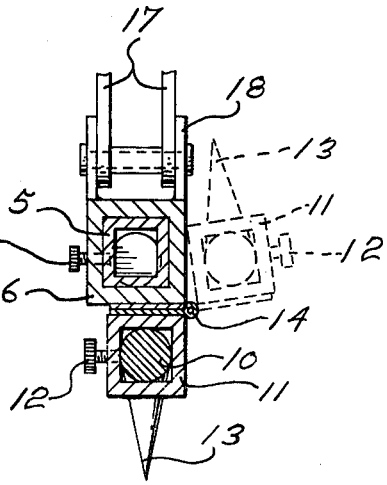
FIG. 3 is a cross-sectional view as seen along line 3—3 in FIG. 2.

The carpet stretcher tool illustrated in FIGS. 1 to 4 inclusive comprises a carpet-engaging head including a pad formed of an inner pad section 1 and an outer pad section 2 which abut edgewise against each other and are thus held by a pair of pins or bolts 3. The latter are removable to allow removal of the outer pad section 2 and thus shortening of the pad, as may be required to operate in a tight space, such as on a step of a stair. Each pad section 1 and 2 is provided with pointed protuberances, such as preferably with needles 4 projecting operatively downwardly from the bottom face thereof. The pad sections 1 and 2 and the needles 4 may be made of any suitable material. In particular, the needles 4 must be sufficiently stiff to engage into the carpet and firmly grip the latter for pulling action thereon.

A rod 5 has one end rigidly secured to the inner pad section 1 and projects away from the latter in the direction of the removable connecting pins 3. A tubular arm 6 of square tubing has one end slidably engaged over the outer end of the rod 5 for endwise sliding on the latter.

A needle bar, or needle 7, has a blunt end inserted into the outer end of the tubular arm 6 where it is held by a setscrew 8, or any other suitable expedient to enable readily adjustment of the outward extension of this needle bar from the tubular arm. The needle bar 7 has a pointed free end portion 9 downwardly inclined in a direction away from the needled pad sections 1 and 2.

A second needle bar 10 is engaged and retained into a tube section 11 by a set screw 12, similarly as needle bar 7, to define a pointed free end 13 operatively pointing donwardly away from the pad sections 1 and 2. A hinge 14 pivotally connects the tube section 11 to the tubular arm 6 to allow pivoting of the tube section 11 and the needle bar 10 about a hinge axis parallel to the longitudinal axis of arm 6 between a lower operative position, shown in full lines in FIGS. 1, 2, and 3 and an upper inoperative or stowed position shown in dotted lines in FIGS. 2 and 3.

An actuating lever 15 is pivoted at one end to lugs or ears 16 rigidly fixed to the needled pad section 1. A double push link 17 is pivoted at one end to an intermediate point of the actuating lever 15 and at the other end to lugs 18 fixed on the arm 6. Thus, the actuating lever 15 projects from the needled pad in the same direction than the tubular arm 6. Link 17 and lever 15 constitute a toggle lever mechanism locking the head in extended position relative to arm 6.

The afore-described carpet stretcher tool is normally used by first setting the distance of the pointed free end 9 relative to the needled pad. This is done, as aforementioned, by sliding the needle bar 7 endwise into the tubular arm 6 and tightening of the setscrew 8. The pointed free end 9 is then made to pierce the carpet and the underlying floor at a selected point and the needled pad sections 1 and 2 are rested on the carpet, not shown, where it needs to be stretched. This is done such that, originally, the actuating arm 15 is angularly set relative to the underlying arm 6, for instance, as shown in FIG. 1. After the needles 4 have gripped the carpet at the desired place, the lever 15 is pressed down such that the push link 17 causes the same and the needled pad to move outwardly under the guidance of the rod 5 then sliding outwardly of the arm 6 while end 9 constitutes a reaction point.

The same tool may be used for a small area of carpet by pivoting the needle bar 10 to its operative position, such that the closer pointed end 13 is used rather than the pointed free end 9. This condition is found, for instance, on a step of a stair. The outer pad section 2 may also be removed to still further reduce the effective distance between the outer edge of the needled pad and the used pointed end, that is the end 13.

Figure 5:
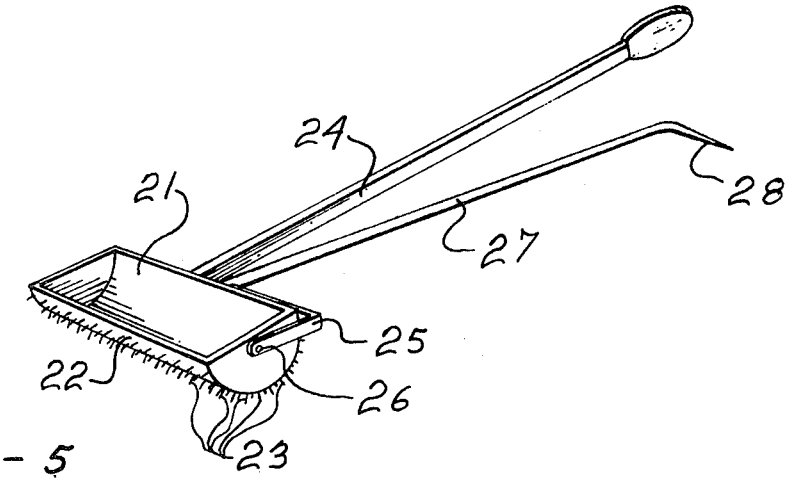
FIG. 5 is a perspective view of a carpet stretcher tool according to a second embodiment of the present invention.
Figure 6:
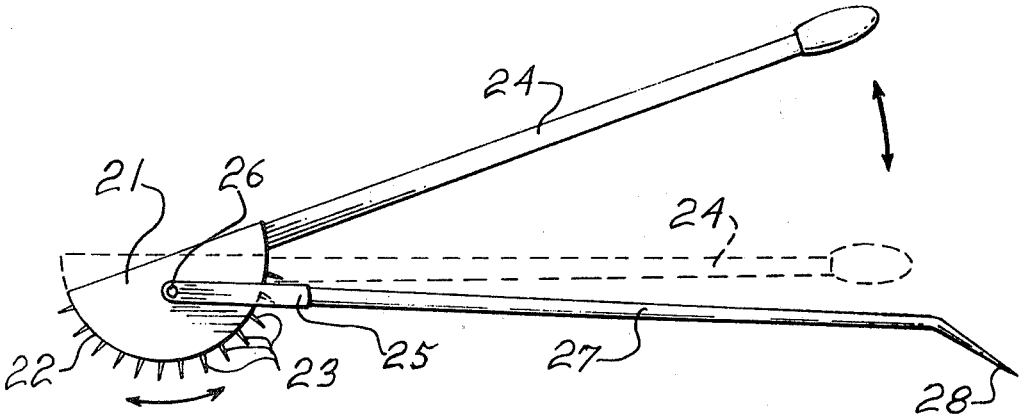
FIG. 6 is a side view of the tool of FIG. 5.

The carpet stretcher tool according to the second embodiment illustrated in FIGS. 5 and 6 inclusive comprises a trough-shaped body 21 defining a cylindrical exterior face 22, or in other words, a surface which is convex in one direction. Needles 23 are fixed to the body 21 and project outwardly from the convex face 22.

An actuating handle, or lever 24, is rigidly secured at one end to the needled body 21 and projects outwardly from the latter in the aforementioned one direction. An arm is provided under the lever 24 and includes a fork shape portion 25 straddling the opposite sides of the body 21 and pivoted thereto at axially opposite points 26 thereof.

A needle bar 27 is rigidly secured at one end to the fork shape portion 25 and forms therewith an elongated structure aligned with the lever 24 in underlying relationship therewith. The needle bar 27 includes a pointed free end pointing downwardly away from the needled body 21. The fixed end of the needle bar 27 may be secured in any appropriate manner to the fork shape portion 25, such as by screwing therein, by welding or bolting thereto.

I claim:

1. A carpet stretcher tool comprising a pad-like head having several pointed needles projecting downwardly and adapted to engage a carpet, a rod secured to said head, projecting endwise away from the latter on one side thereof, a tubular arm telescopically receiving said rod at its inner end, a first needle bar secured to the outer end of said tubular arm and having a pointed free end portion downwardly inclined in a direction away from said head, a tube section hinged to said tubular arm at a point intermediate the ends of said tubular arm about a hinge axis parallel to the longitudinal axis of said tubular arm for pivotal movement between an upper inoperative position alongside said tubular arm and a lower operative position underneath said tubular arm, a second needle bar secured to said tube section and having a pointed free end portion downwardly inclined in a direction away from said head in the lower operative position of said tube section, and manually-operated toggle lever means connected to said head and tubular arm to displace said head away from said tubular arm, while being guided by said rod sliding in said tubular arm, said needle bars selectively adapted to pierce a carpet and the underlying floor to act as a reaction point for stretching said carpet away from said point by means of said carpet-engaging needles.

2. A carpet stretcher tool as defined in claim 1, wherein both needle bars are removably and adjustably secured into the outer end of said arm and into said tube section respectively.

3. A carpet stretcher tool as defined in claim 1, wherein said head includes a pair of pad sections releasably connected into edgewise adjoining relationship and in alignment with said arm, and each having several pointed needles, said pad sections include an inner pad section closer to said arm and an outer pad section farther from said arm, and said outer pad section is removably connected to said inner pad section for selective separation from the latter and shortening of said stretcher lengthwise of said arm.

4. A carpet stretcher tool as defined in claim 3, wherein said carpet-engaging head includes a pair of pins projecting lengthwise of said arm and removably connecting said outer pad section to said inner pad section.

5. A carpet stretcher tool as defined in claim 4, further including a short tubular section extending lengthwise of said tubular arm and a hinge pivotally securing said short tubular section to said tubular arm for pivotal displacement of the same about a pivot axis extending lengthwise of said arm between a lowered operative position and an elevated inoperative position.

* * * * *